US007174608B2

(12) United States Patent
Ching

(10) Patent No.: US 7,174,608 B2
(45) Date of Patent: Feb. 13, 2007

(54) METHODS AND APPARATUS FOR GRIPPING ARTICLES

(76) Inventor: Henry Kong Sun Ching, 220 Riverside Blvd., Apt. 27C, New York, NY (US) 10069

( * ) Notice: Subject to any disclaimer, the term of this patent is extended or adjusted under 35 U.S.C. 154(b) by 0 days.

(21) Appl. No.: 10/975,807

(22) Filed: Oct. 28, 2004

(65) Prior Publication Data

US 2005/0108856 A1 May 26, 2005

Related U.S. Application Data

(60) Provisional application No. 60/524,534, filed on Nov. 24, 2003.

(51) Int. Cl.
*B42F 1/02* (2006.01)

(52) U.S. Cl. ..... 24/522; 24/7; 24/67.3; 24/67.9; 24/528

(58) Field of Classification Search ..... 24/67 R–67.5, 24/67.9, 67.11, 522, 527, 528, 7
See application file for complete search history.

(56) References Cited

U.S. PATENT DOCUMENTS 267,498 A * 11/1882 Cox ..... 24/522
2,704,872 A * 3/1955 Waggoner et al. ..... 24/522
4,829,789 A * 5/1989 Tsamas ..... 63/14.3
4,897,898 A * 2/1990 Chapin ..... 24/3.12
4,956,899 A * 9/1990 Green ..... 24/488
5,309,605 A * 5/1994 Sato ..... 24/67.9
6,254,136 B1 * 7/2001 Patel ..... 281/42
2003/0101545 A1 * 6/2003 Hsiao ..... 24/67.9

FOREIGN PATENT DOCUMENTS

GB 2226073 A * 6/1990
JP 10203069 A * 8/1998

* cited by examiner

*Primary Examiner*—James R. Brittain
(74) *Attorney, Agent, or Firm*—Kaplan Gilman Gibson & Dernier LLP

(57) ABSTRACT

An apparatus includes: a base having at least one surface lying substantially in a base plane; a first member extending substantially perpendicularly from the surface of the base and defining an aperture therein; and a second member having a proximal end coupled to the surface of the base and a distal end, the second member defining a second plane extending transversely from the base plane of the base at least toward the aperture, wherein the orientation of the second member biases the second member toward the first member such that an article may be gripped therebetween.

9 Claims, 11 Drawing Sheets

METHODS AND APPARATUS FOR GRIPPING ARTICLES

CROSS REFERENCE TO RELATED APPLICATIONS

This application is based on and claims the benefit of U.S. Provisional Patent Application No.: 60/524,534, filed Nov. 24, 2003, the entire disclosure of which is hereby incorporated by reference.

BACKGROUND OF THE INVENTION

The present invention relates to methods and apparatus for gripping articles, such as paper, cloth, napkins, etc., and/or even heavier objects as well.

When gripping elements together with a gripping device, such as a common paperclip, a mechanical stress is usually placed against two opposing clamping elements. Often this stress is sufficient enough to cause one or both clamping elements to deform. Once deformed, the two clamping elements can no longer apply a sufficient force to grip further objects in subsequent uses. A consumer is then forced to discard the deformed device and purchase an additional one.

SUMMARY OF THE INVENTION

In accordance with one or more embodiments of the present invention, a device may be used and reused to grip objects together while reducing the mechanical stress placed on the elements of the gripping device when it is in use to grip one or more articles.

In accordance with one or more embodiments of the present invention, a device may include two planar prongs offset and transverse to one another. Preferably, this feature enables the gripping device to absorb a greater force against separating the two prongs without causing the device to deform to a point where it can no longer be satisfactorily reused or utilized. Furthermore, the flexibility of the two prongs provides the clamping force required to grasp items as compared to prior art devices that deform in order to apply a clamping force. The present invention may be adapted to gripping goods of varying sizes and shapes and may be constructed from various plastics, metals, metal alloys, and combinations thereof. A coating may be disposed over the device as well.

Additionally, the prongs of the gripping device may be constructed having a cross section with a relatively small diameter, approximately in the range of one millimeter. A larger diameter may also be utilized to provide a stronger clamping force. The device may also be constructed having a length and a width as compared to a diameter. Thus, the prongs of the device may have a cross-section that is circular, rectangular, square or even have a different shape.

In accordance with one or more embodiments of the present invention, the gripping device may consist of a single strand of metal having various bends. A preferred embodiment may have a proximal end and a distal end and include two prongs both having an inwardly concaved arc located at the distal end of the device. At the ends of the inwardly concaved arcs are two sets of lateral legs extending towards the proximal end of the device. The first set of lateral legs comprises the top prong with a longitudinal axis substantially parallel to a horizontal reference plane. As used herein, directional terms such as "upwardly", "downwardly", "top" or "bottom", or "laterally" do not refer to any gravitational frame of reference. Rather, these directional terms are relative to the device.

In accordance with one or more embodiments of the present invention an apparatus includes: a base having at least one surface lying substantially in a base plane; a first member extending substantially perpendicularly from the surface of the base and defining an aperture therein; and a second member having a proximal end coupled to the surface of the base and a distal end, the second member defining a second plane extending transversely from the base plane of the base at least toward the aperture, wherein the orientation of the second member biases the second member toward the first member such that an article may be gripped therebetween.

Preferably, at least one of: the second member extends transversely from the surface of the base at an angle of about 45 degrees; and the second member extends transversely from the surface of the base at an angle of about 30–60 degrees.

The apparatus may include an actuator slideably disposed within the aperture and including a biasing surface oriented below the first plane and substantially between the first and second members, wherein the orientation of the second member biases the second member toward the first member such that an article may be gripped therebetween and sliding the actuator in a direction from the base toward a distal end of the first member increases the grip on the article.

The actuator may include: a head disposed above the first plane; and a shaft extending from the head through the aperture and coupling the head and the biasing surface in spaced apart orientations with respect to one another.

In one or more embodiments, the apparatus may include: at least one channel extending one of: (i) proximate to the aperture of the first member, and (ii) along the shaft; and at least one key extending the other of: (i) along the shaft, and (ii) proximate to the aperture of the first member, wherein the at least one key is slideably engaged with the at least one channel to facilitate the orientation of the actuator.

In one or more embodiments, the aperture may include an oversized portion proximate the base and having a size and shape such that the biasing surface may be moved therethrough and the actuator may be separated from first and second members.

The apparatus may include detent means disposed on at least one of the shaft and walls of the aperture such that the sliding position of the actuator may be semi-fixed.

Other aspects, features, advantages, etc. will become apparent to one skilled in the art when the description of the invention herein is taken in conjunction with the accompanying drawings.

BRIEF DESCRIPTION OF THE DRAWINGS

For the purposes of illustration, forms are shown in the drawings that are preferred, it being understood, however, that the present invention is not limited to the precise arrangements or instrumentalities shown.

DETAILED DESCRIPTION OF EMBODIMENTS OF THE INVENTION

Figure 1:
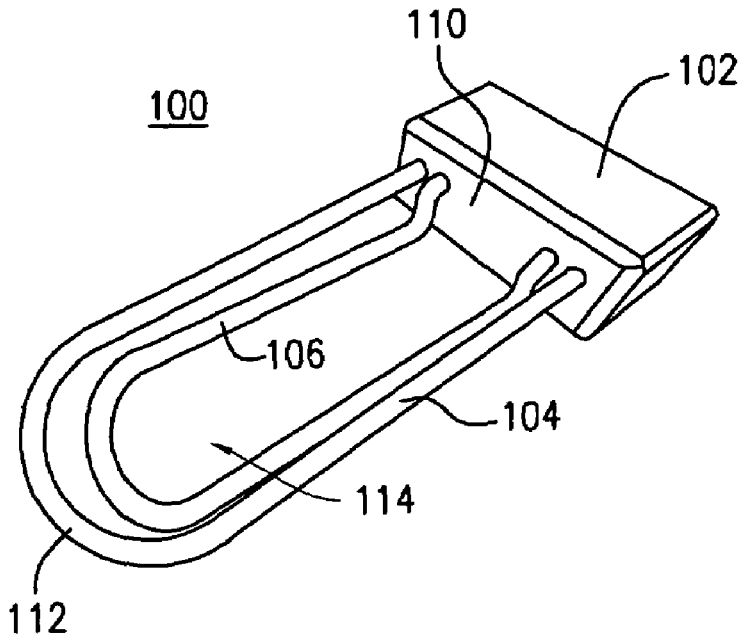
FIGS. 1–2 are perspective views of a gripping device in accordance with one or more embodiments of the present invention.

Reference is now made to FIG. 1, which is a perspective view of a gripping device 100 of a first embodiment of the present invention. The gripping device 100 includes a base 102, a first member 104, and a second member 106. In this embodiment, the base 102 is of a parallelepiped configuration including at least one surface 110 defining a base plane. The first member 104 is of a looped wire construction, wherein one end of the wire extends substantially perpendicularly from the surface 110 of the base 102, loops at its distal end 112 and returns to and/or through the surface 110 of the base 102. The first member 104 defines an aperture 114.

The second member 106 is also preferably of a looped wire construction having a proximal end 116 and a distal end 118. The proximal end 116 of the second member 106 is coupled to the base 102, e.g., through the surface 110. One end of the wire forming the second member 106 includes a first portion 106A extending substantially perpendicularly out through the surface 110 of the base 102, a second portion 106B extending from the first portion 106A substantially parallel to the base plane, and a third portion 106C extending from the second portion 106B transversely with respect to the base plane. The wire forming the second member 106 loops at the distal end 118 and returns to the base 102 in a substantially similarly way as the other portion of the wire.

The respective second portions 106C of the second member 106 define a second plane extending transversely from the base plane of the base 102 at least toward the aperture 114. The orientation of the second member 106 biases the second member 106 toward the first member 104 such that an article (such as one or more pieces of paper) may be gripped therebetween.

As illustrated by the reference designator labeled ANGLE, the second member 106 may extend transversely from the surface 110 of the base 102 at an angle of about 30–60°. In a preferred embodiment, the angle is about 45°.

In addition to the angle feature, the gripping portion, including at least 106C, of the second member 106 is offset from the first member 104 by way of the extension of the second portions 106A. This offset feature enables the gripping device 100 to accept large products between the first and second elements 104, 106 as compared to prior art designs. The further the distance the second member 106 is offset from the first member 104 has a direct relationship to the amount of pressure placed on an object therebetween. Additionally, the first and second members 104, 106 may absorb a greater amount of mechanical strain without causing deformity to the device 100 that would prohibit the reuse of the device. This is because the device 100 clamps an article between the two members 104, 106 by taking advantage of the flexibility and offset aspect of specifically the second element 106. Because the second member 106 is offset and transverse to the first member 104, it may flex between positions, for example, a position where it does not intersect the first plane and a position where it intersect or nearly intersects the first plane. The flexing of the second member 106 takes place along the curved portions thereof, which provide a reactive force urging the member 106 to flex back into position.

An optional feature of the gripping device 100 may include a receiving element at the distal end 118 of the second member 106. The receiving element may extend in a direction transverse to both the first and second planes such that the receiving element urges an object between the first and second members 104, 106 for gripping therebetween. In an alternative embodiment, the receiving element may be employed on the first member 104 and/or on both the first member 104 and the second member 106.

The base 102, the first member 104, and the second member 106 may be formed from at least one of metal, plastic, an alloy, and/or combinations thereof.

Figure 3:
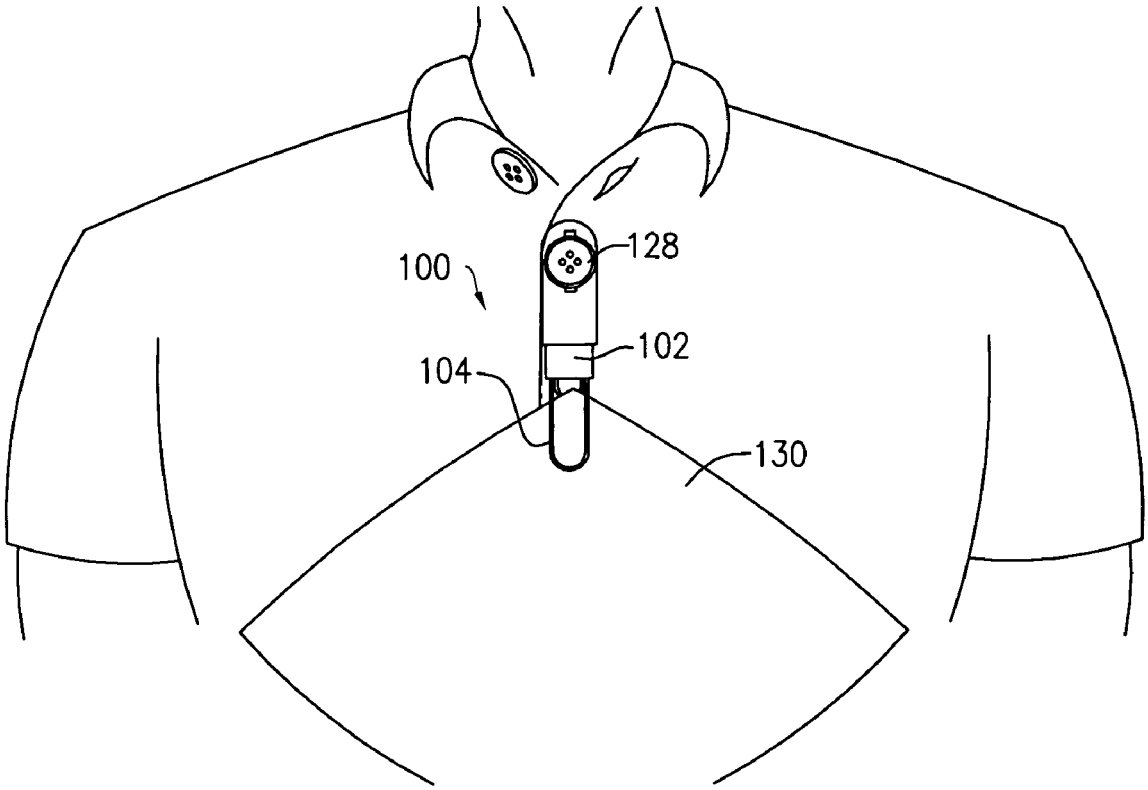
FIGS. 3–4 are perspective views of a gripping device in accordance with one or more further embodiments of the present invention.
Figure 4:
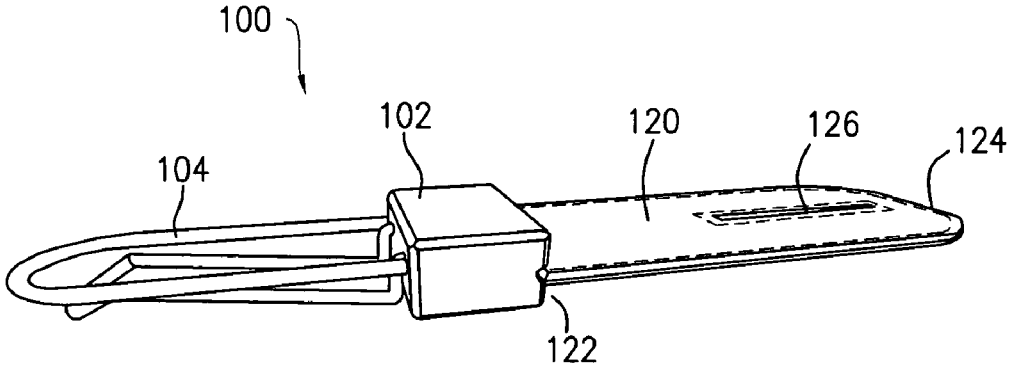

With reference to FIGS. 3 and 4, the gripping device 100 may be employed in an alternative embodiment of the invention. In particular, the apparatus may further include an attachment member 120 including a proximal end 122 attached to the base 102 and a distal end 124. In a preferred embodiment, the proximal end 122 extends substantially perpendicularly from a surface of the base 102 such that at least substantial portions of the attachment member 102 lie in a plane parallel to the first plane formed by the first member 104. The attachment member 120 preferably includes a button hole 126 disposed proximate to the distal end 124 and is operable to receive a button 128 on the garment of a user. In the alternative, a different type of attachment feature may be employed besides the button hole 126, such as a clip, Velcro, etc. In this configuration, the gripping device 100 may be utilized to grip a napkin 130, such as at the corner thereof, in order to attach the napkin 130 to the garment of the user.

It is noted that the attachement member may be utilized with any of the other embodiments shown and described herein to form further embodiments of the present invention.

Figure 2:
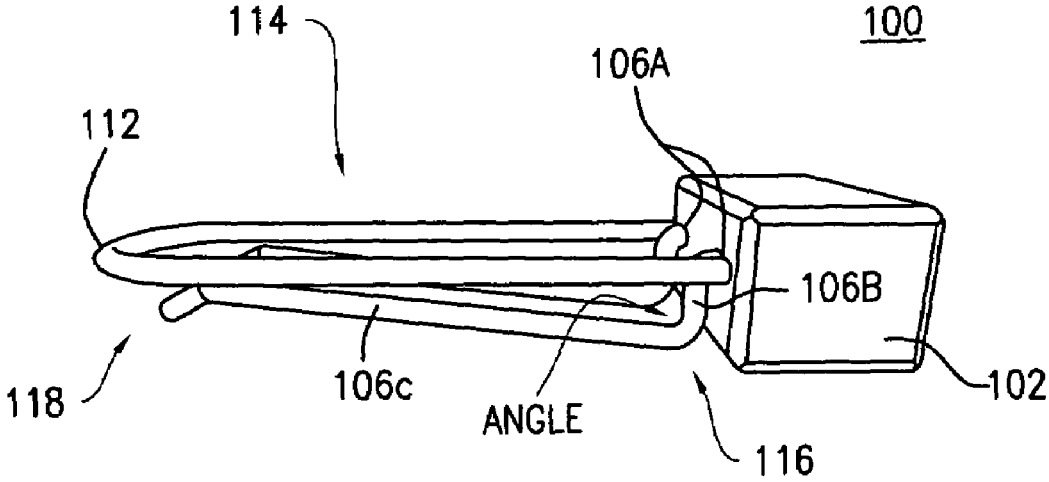
Figure 5:
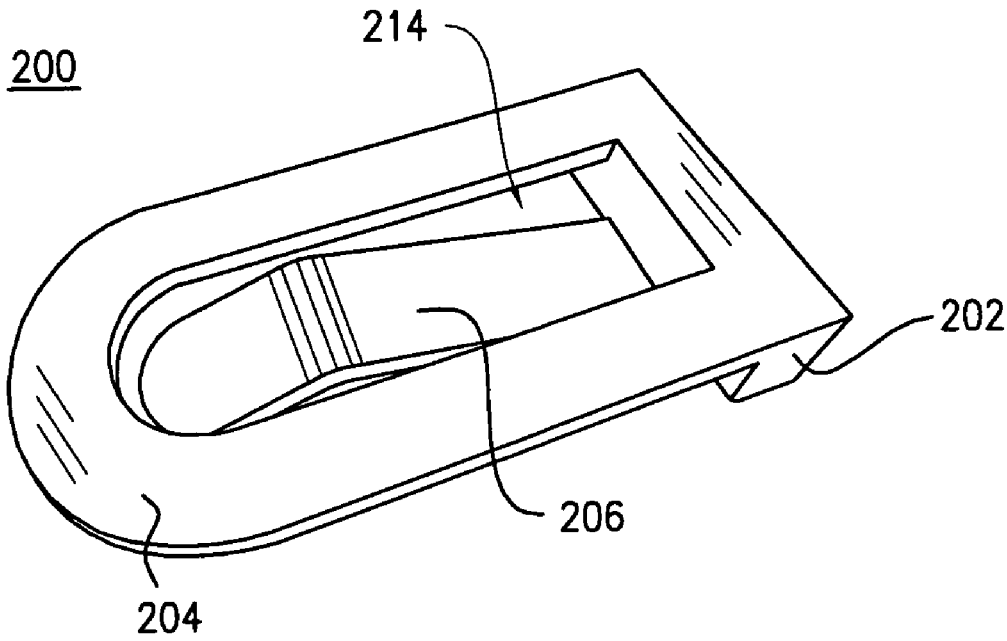
FIGS. 5–6 are perspective views of a gripping device in accordance with one or more further embodiments of the present invention.
Figure 6:
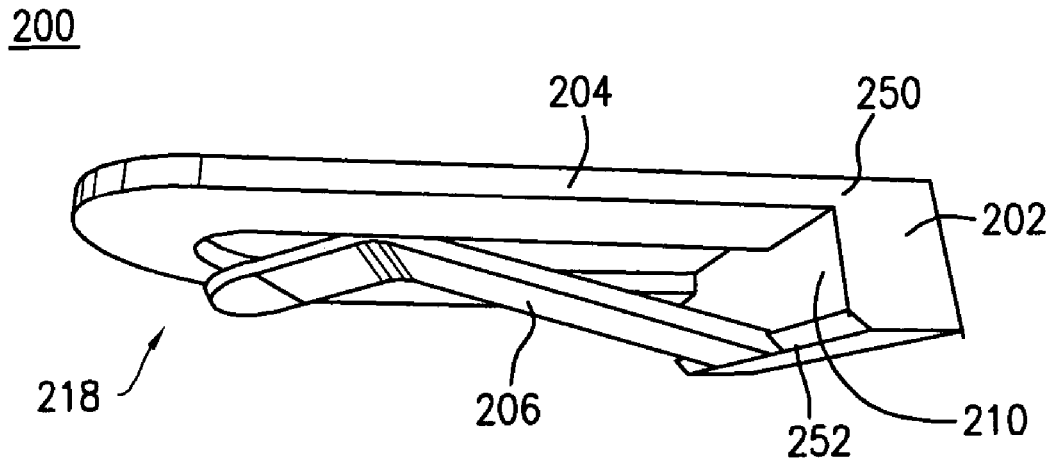

Reference is now made to FIGS. 5 and 6, which illustrate a gripping device 200 in accordance with a further embodiment of the present invention. The gripping device 200 includes some of the same features as the gripping device 100 of FIGS. 1–2, although the first and second members 204, 206 of this embodiment are not formed of wire. Instead, the first and second members 204, 206 are formed having a rectangular cross-section. The base 202 of this embodiment may extend at an upper edge 250 thereof to form the first member 204. While the first member 204 may retain the loop characteristic to form the aperture 214, the second member 206 is preferably not of a loop configuration. Instead, the second member 206 preferably extends from a lower edge 252 of the base 202 from one place. The width of the second member 206 is preferably narrower than the base 202 such that the distal end 218 thereof may approach and at least partially enter the aperture 214. In alternative embodiments, the width of the second member 206 may be the same as or wider than the base 202.

The second member 206 preferably extends transversely from the surface 210 of the base 202 at an angle of about 30–60°, and preferably at an angle of about 45°. As the first member 204 extends from the upper edge 250 of the base 202 and the second member 206 extends from the lower edge 252 of the base 202, the device 200 enjoys the offset feature described hereinabove.

Figure 7:
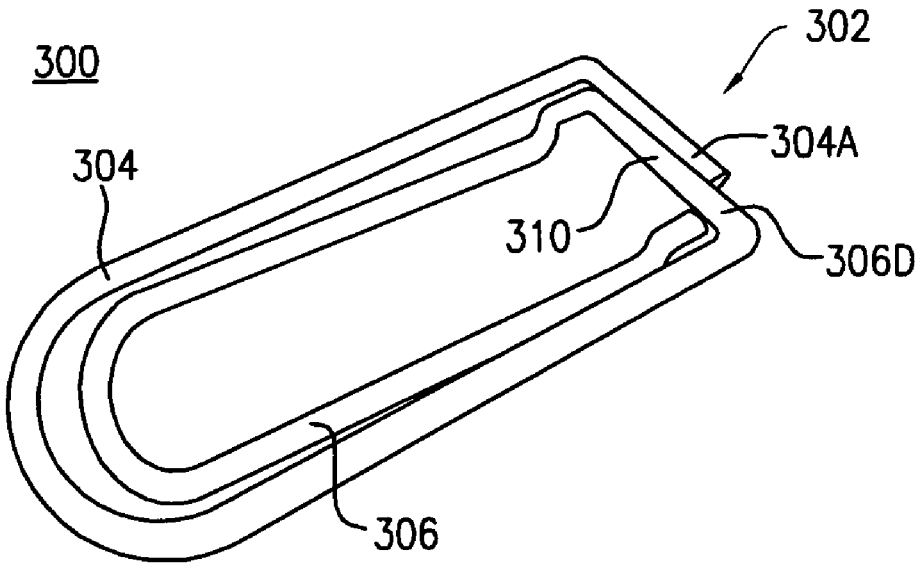
FIGS. 7–8 are perspective views of a gripping device in accordance with one or more further embodiments of the present invention.
Figure 8:
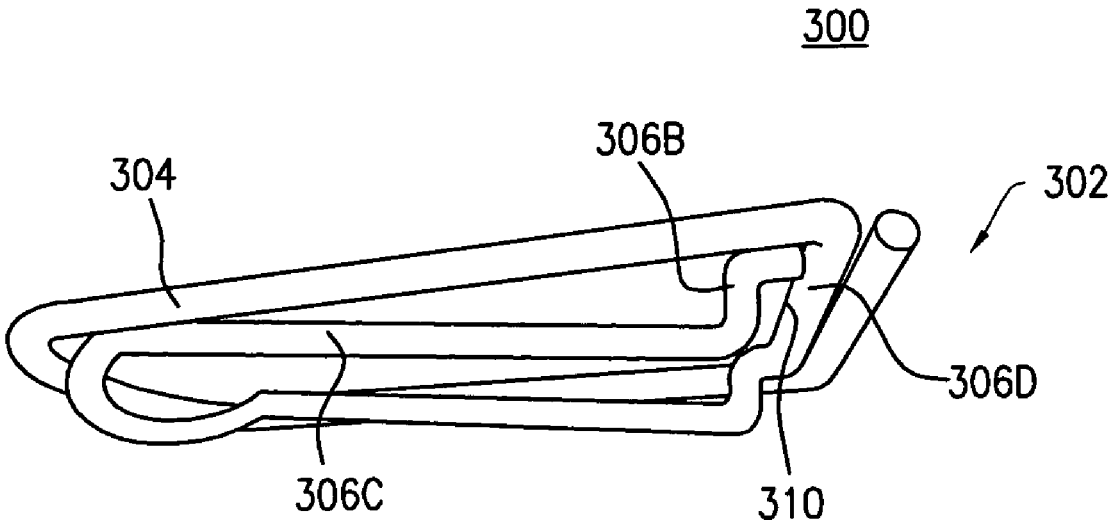

Reference is now made to FIGS. 7 and 8, which illustrate a gripping device 300 in accordance with an alternative embodiment of the present invention. The gripping device 300 includes some of the same features as the gripping device 100 of FIGS. 1–2, although the base 302 is of an alternative construction. In particular, a base portion 306D of the second member 306 serves to define the base plane and the surface 310 from which various elements of the device 300 depend. Preferably, the gripping device 300 is formed from a single wire that has been bent in various places to define the structural features and functional aspects of the device. In a preferred embodiment, the first member 304 includes a base portion 304A that is disposed proximate to the base portion 306D of the second member 306 and also contributes to defining the base 302. The base portions 304A, 306D may be joined together to provide desirable stiffness to the gripping device 300.

Figure 9:
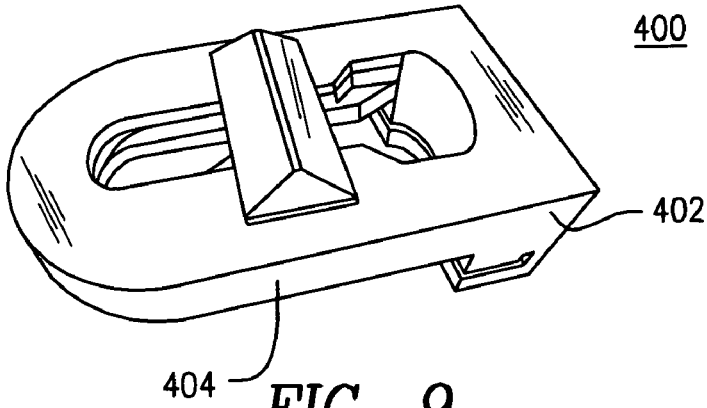
FIGS. 9–11 are perspective views of a gripping device in accordance with one or more further embodiments of the present invention.
Figure 10:
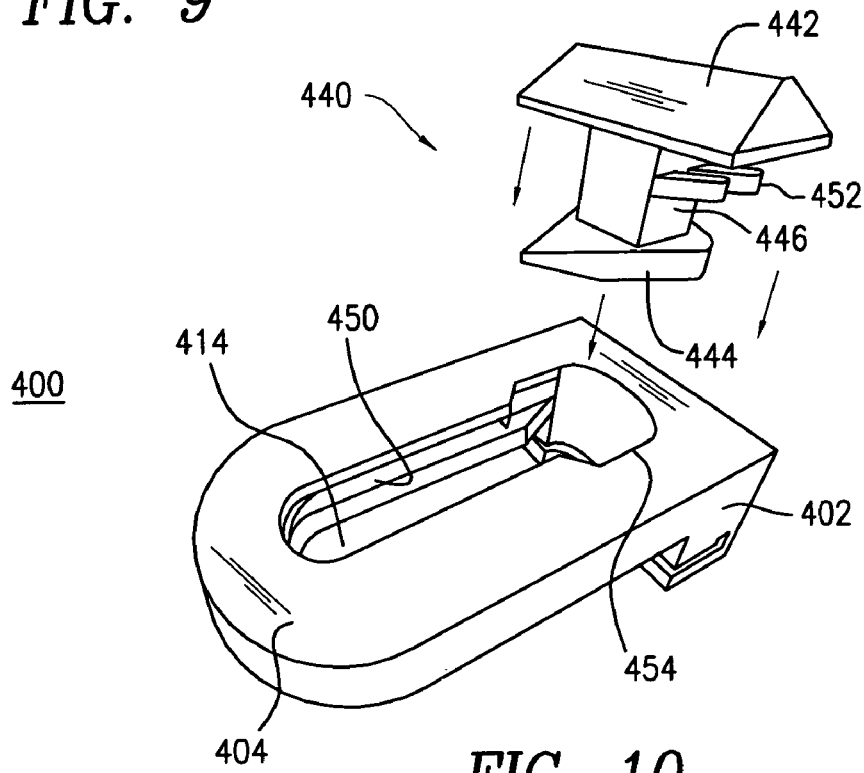
Figure 11:
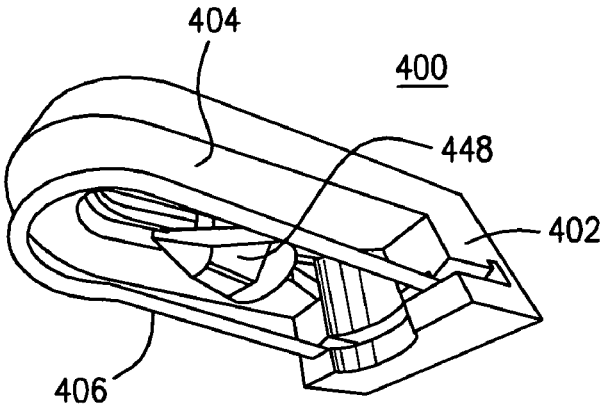
Figure 12:
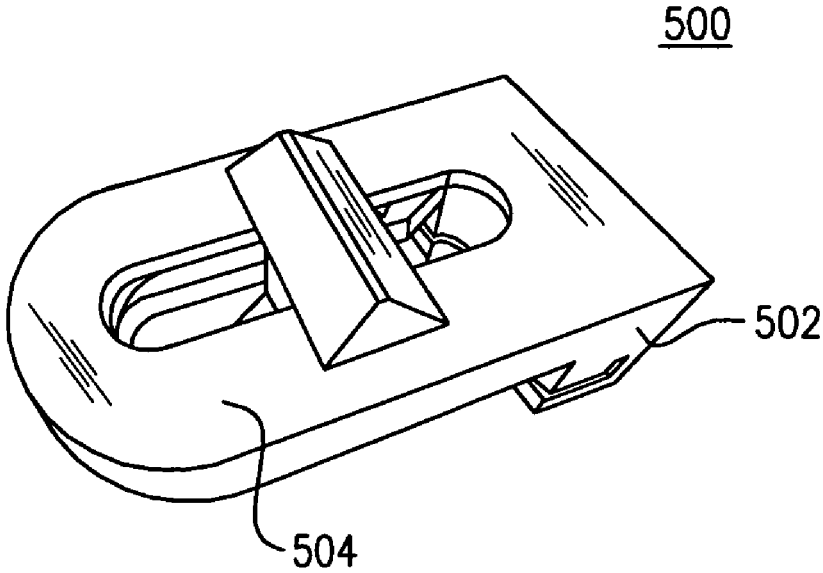
FIGS. 12–15 are perspective views of a gripping device in accordance with one or more further embodiments of the present invention.
Figure 13:
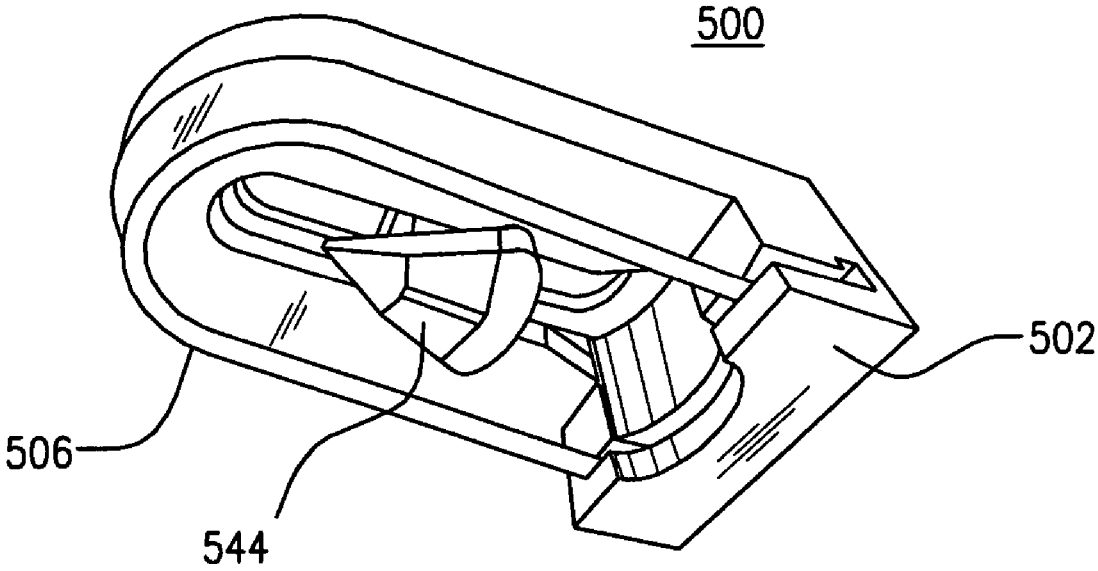

Reference is now made to FIGS. 9–11, which illustrate a gripping device 400 in accordance with an alternative embodiment of the present invention. The gripping device 400 includes some of the same features as the gripping device 100 of FIGS. 1–2 and the gripping device 200 of FIGS. 5–6. For example, the base 402 and the first member 404 of the device 400 are substantially similar to the corresponding elements of the gripping device 200. As will be discussed further hereinbelow, however, the first member 404 of the gripping device 400 may have a thickness greater than that of the gripping device 200 to accommodate additional features. Further, the construction of the second member 406 is preferably of substantially similar construction as the corresponding element of the gripping device 100 of FIGS. 1–2.

The gripping device 400 also includes an actuator 440 slideably disposed within the aperture 414 such that sliding the actuator 440 in a direction from the base 402 toward a distal end of the first member 404 increases the grip on the article. The actuator 440 includes a head 442, an engagement member 444, and a shaft 446 coupling the head 442 and the engagement member 444 together. At least a portion of the head 442 is disposed above the first member 404 (and therefore above the first plane), while at least a portion of the engagement member 444 is disposed below the first member 404 (and therefore below the first plane). The shaft extends from the head 442 through the aperture 414 and couples the engagement member 442 in spaced apart orientation.

Preferably, the engagement member 444 includes a biasing surface 448 oriented below the first plane and substantially between the first and second members 404, 406. When the head 442 of the actuator 440 is pushed by the user toward the distal end of the first member 404, the biasing surface 448 of the engagement member 444 presses against the article and urges same against the second member 406 to improve the gripping action. Preferably, the biasing surface 448 of the actuator 440 is wedge-shaped. By way of example, the biasing surface 448 may include a tapered end oriented towards an insertion direction of the article to facilitate such insertion.

To assist in the sliding of the actuator 440, the first member 404 preferably includes a channel 450 extending along one or both sides of the aperture 414. One or more corresponding keys 452 are preferably disposed on the shaft 446 such that the one or more keys 452 slideably engage with the one or more channels 450 to facilitate the orientation of the actuator 440 with respect to the first member 404. In an alternative embodiment, the one or more keys 452 may be disposed on or in the first member 404 proximate to the aperture 414, while the one or more channels may be disposed on the shaft 446.

IN an alternative configuration, respective stoppers may be provided at the ends of the one or more channels 450 where the keys 452 are slideably received. The stoppers reduce the lateral dimension extending between the channels 452. The optional slanting of the keys 452 permits them to slightly deform inward as they engage the stoppers located at the entrance of the channels 450. However, once the keys 452 pass the stoppers they deform back to their original shape and are located in the channels 450. Because the keys 452 are slanted from front to back, they can not deform inwardly to bypass the stoppers and exit the channels 450.

In accordance with an alternative aspect of this embodiment, the aperture 414 may include an oversized portion 454 proximate to the base 402 and having a size and shape such that the engagement member 444 may be moved therethrough and the actuator 440 may be separated from the first member 404.

The head 442 of the actuator 440 is coupled to the shaft 446 and has a width larger than the width of both the oversized portion 454 as well as the aperture 414. Thus, when first placing the actuator 440 within the aperture 414, the engagement member 444 is placed through the aperture 414 until it is lower than the bottom surface of the first member 404. The shaft 446 is substantially disposed within the aperture 414. The actuator 440 tilts forward. This causes the engagement member 444 of the locking element to also tilt thereby increasing the amount of force the engagement member 444 exerts downward. Thus, an increased force is applied against the material located between the engagement member 444 and the second member 406. This aspect of the invention provides a more secure gripping device as compared to prior systems.

Figure 14:
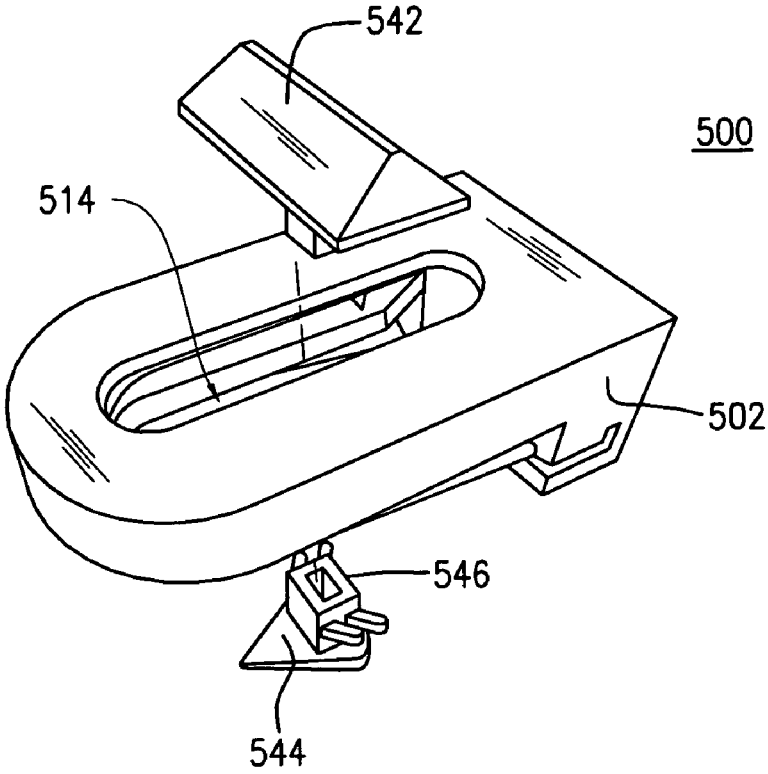
Figure 15:
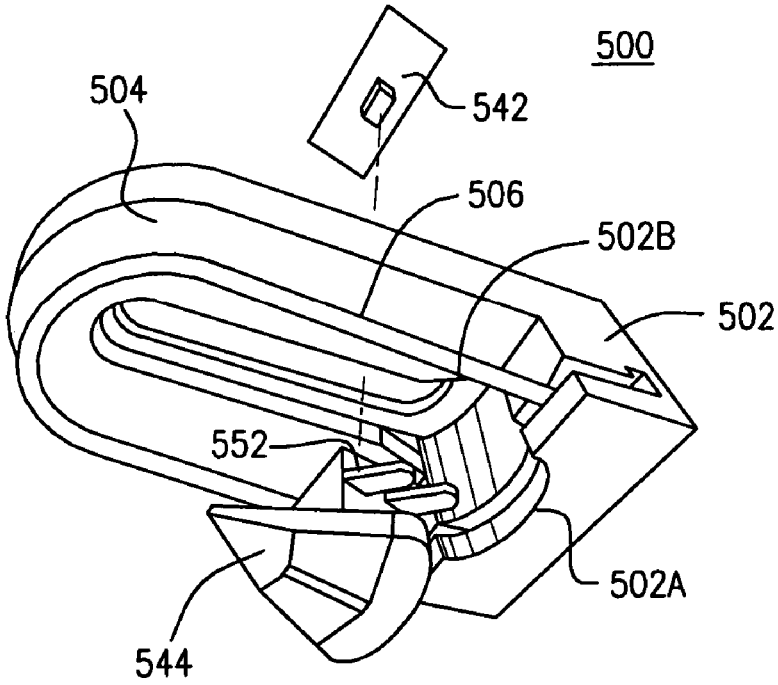
Figure 16:
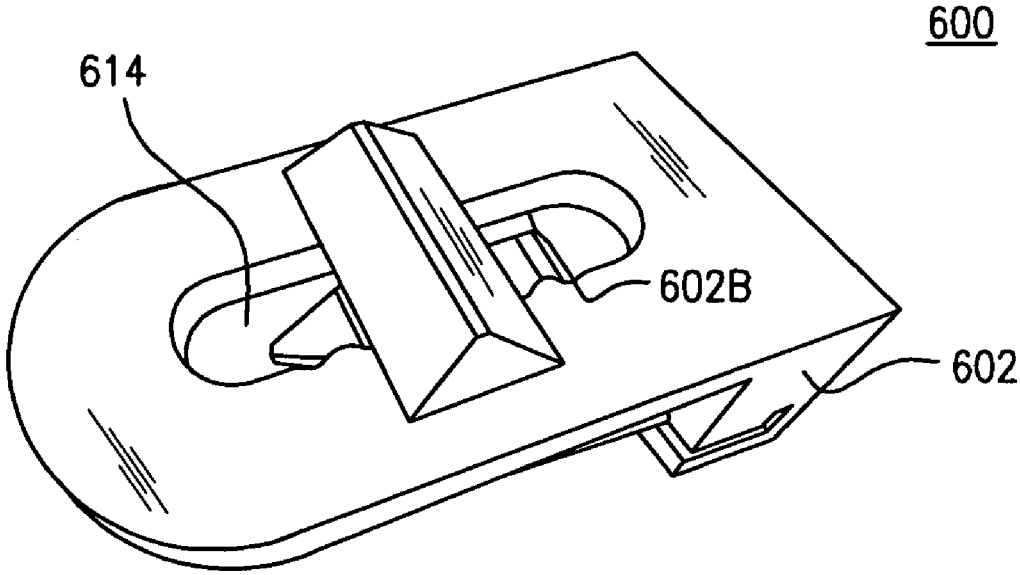
FIGS. 16–19 are perspective views of a gripping device in accordance with one or more further embodiments of the present invention.
Figure 17:
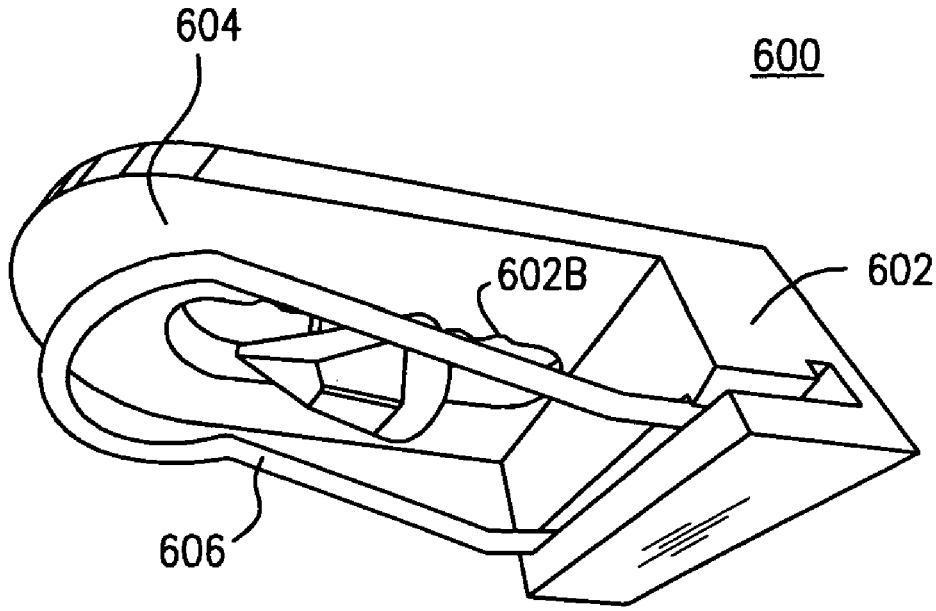
Figure 18:
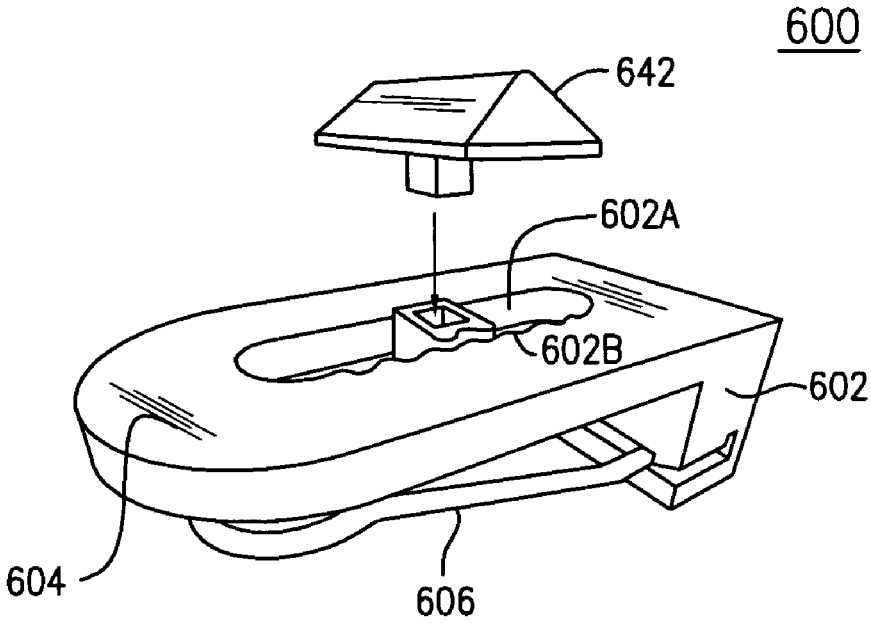
Figure 19:
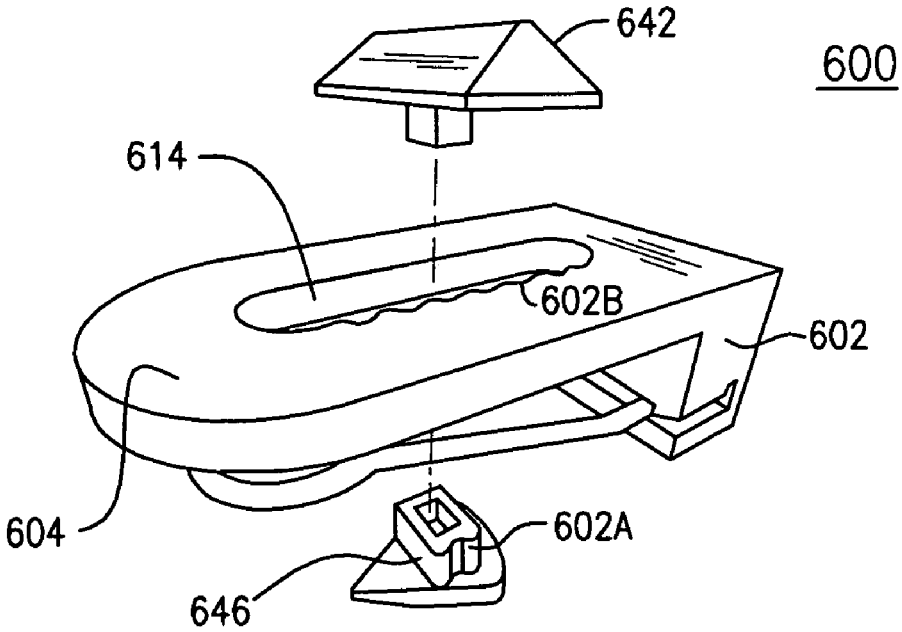
Figure 20:
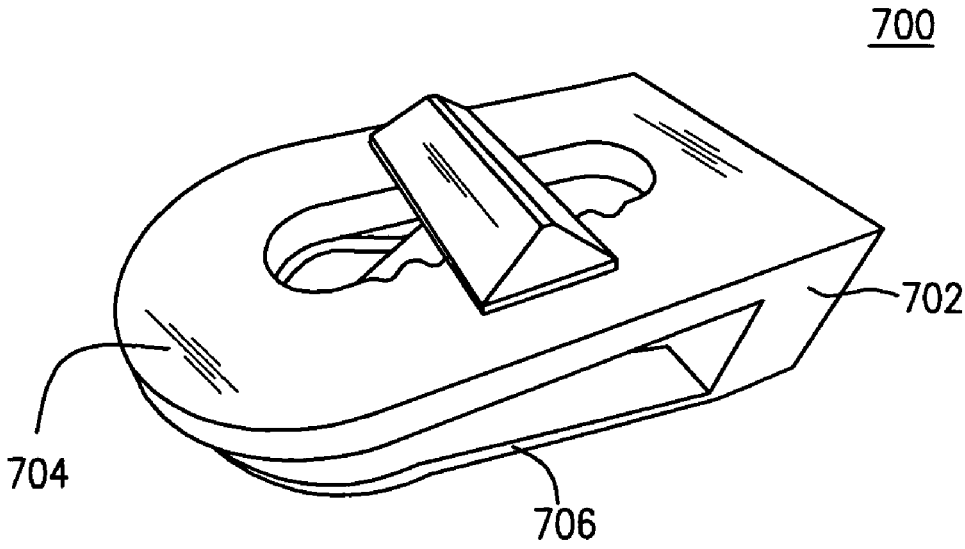
FIGS. 20–23 are perspective views of a gripping device in accordance with one or more further embodiments of the present invention.
Figure 21:
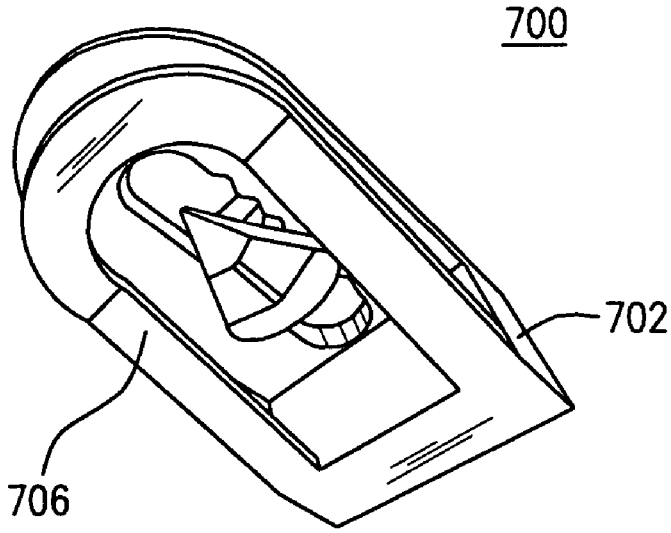
Figure 22:
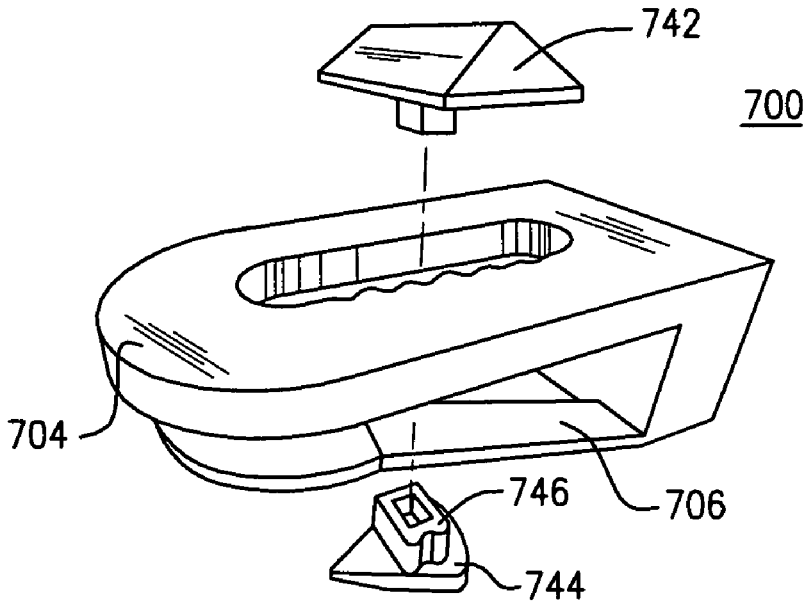
Figure 23:
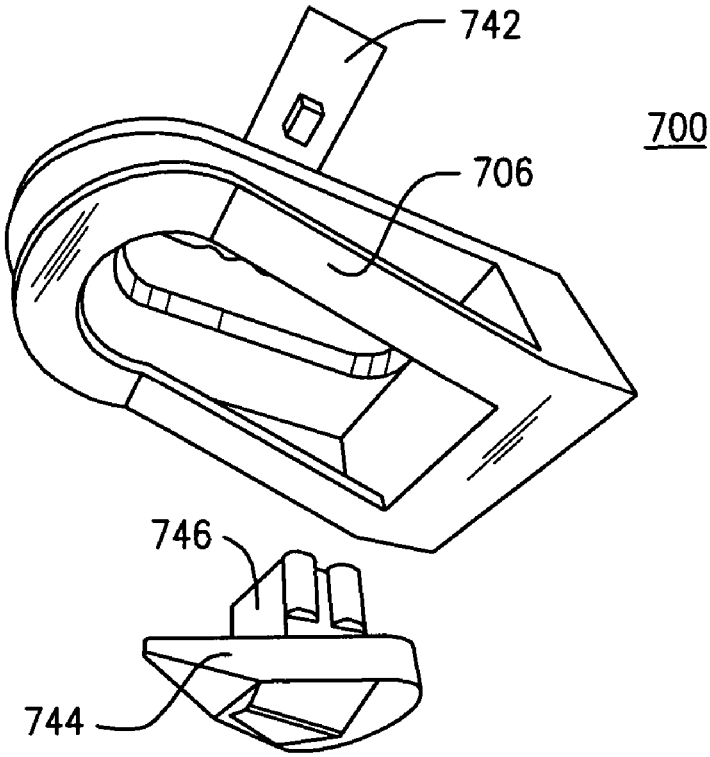

Reference is now made to FIGS. 12–15, which illustrate a gripping device 500 in accordance with one or more further embodiments of the present invention. The gripping device 500 is substantially the same as the gripping device 400 of FIGS. 9–10, although the aperture 514 does not include the oversized portion 454. Instead, the actuator 440 is separable such that at least one of the head 542 and the engagement member 544 may be removed from the shaft 546 (as best seen in FIGS. 14–15). With these elements separated, the head 542 may be disposed from above the aperture 514, while the engagement member 544 may be disposed from below the aperture 514. When in position, the head 542 and the engagement member 544 may be coupled to one another utilizing any suitable means, such as glue, epoxy, snap-fit, friction-fit, etc. It is preferred that the aperture 514 and/or the base 502 include some relief 502A, 502B in order to facilitate insertion of the shaft 546 and/or the one or more keys 552.

Reference is now made to FIGS. 16–19, which illustrate a gripping device 600 in accordance with one or more further embodiments of the present invention. The gripping device 600 is preferably substantially similar to the gripping device 500 of FIGS. 12–15; however, this embodiment of the present invention further includes detent means 602 A, 602B such that the sliding position of the actuator 640 may be semi-fixed or at least resistant to sliding out of position once moved to a desirable position by the user. In particular, the detent means 602A, 602B may include detents 602A disposed on the shaft 646 and/or detents 602B disposed on or along the aperture 614. In the illustrated embodiment, the detents 602B are disposed along only one side of the aperture 614. In accordance with alternative embodiments of the present invention, the detents 602B may be disposed along both sides of the aperture 614.

Reference in now made to FIGS. 20–23, which illustrate a gripping device 700 in accordance with one or more further embodiments of the present invention. The gripping device 700 is preferably substantially similar to the gripping device 600 of FIGS. 16–19, although the second member 706 is of rectangular cross section as opposed to the circular cross section (wire) of the second member 606 of the gripping device 600.

Preferably, each of the gripping devices described hereinabove may incorporate any number of the design details from the various embodiments of the invention as will be readily apparent to one of ordinary skill in the art having considered this detailed description.

Although the invention herein has been described with reference to particular embodiments, it is to be understood that these embodiments are merely illustrative of the principles and applications of the present invention. It is thereof to be understood that numerous modifications may be made to the illustrative embodiments and that other arrangements may be devised without departing from the spirit and scope of the present invention as defined by the appended claims.

The invention claimed is:

1. An apparatus, comprising:

a base having at least one surface lying substantially in a base plane;

a first member extending substantially perpendicularly from the surface of the base and defining an elongated aperture therein the first member defining a first plane extending transversely from the base plane;

a second member having a proximal end coupled to the surface of the base and a distal end, the second member defining a second plane extending transversely from the base plane of the base at least toward the aperture; and an actuator slideably disposed within the aperture and including a biasing surface oriented below the first plane and substantially between the first and second members, the actuator including a head diposed above the first plane, and a shaft extending from the head through the aperture and coupling the head and the biasing surface in spaced apart orientations with respect to one another, the actuator further including at least one channel extending proximate to the aperture of the first member and at least one key extending along the shaft such that the at least one key is slideably engaged with the at least one channel to facilitate the orientation of the actuator, wherein the orientation of the second member biases the second member toward the first member such that an article may be gripped therebetween and sliding the actuator in a direction from the base toward a distal end of the first member increases the grip on the article.

2. The apparatus of claim 1, wherein the biasing surface of the actuator is wedge-shaped.

3. The apparatus of claim 2, wherein the biasing surface of the actuator includes a tapered end oriented towards an insertion direction of the article to facilitate such insertion.

4. The apparatus of claim 1, wherein the aperture includes an oversized portion proximate the base and having a size and shape such that the biasing surface may be moved therethrough and the actuator may be separated from first and second members.

5. The apparatus of claim 1, wherein the second member extends transversely from the surface of the base at an angle of about 45 degrees.

6. The apparatus of claim 1, wherein the second member extends transversely from the surface of the base at an angle of about 30–60 degrees.

7. The apparatus of claim 1, wherein the distal end of the second member includes a receiving element extending in a direction transverse to both the first and second planes such that the receiving element urges an object between the first and second members for gripping therebetween.

8. The apparatus of claim 1, wherein the first and second members are at least one of circular in cross-section and rectangular in cross-section.

9. The apparatus of claim 1, wherein the first and second members are formed from at least one of metal, plastic, an alloy, and combinations thereof.

* * * * *